US005872506A

United States Patent [19]

O'Brien et al.

[11] Patent Number: 5,872,506

[45] Date of Patent: Feb. 16, 1999

[54] PIEZOELECTRIC TRANSDUCER HAVING DIRECTLY MOUNTED ELECTRICAL COMPONENTS AND NOISE MAKING DEVICE UTILIZING SAME

[75] Inventors: Daniel W. O'Brien, Morgantown; Robert L. Leonard, Jr., Indianapolis, both of Ind.

[73] Assignee: Yosemite Investment, Inc., Indianapolis, Ind.

[21] Appl. No.: 832,924

[22] Filed: Apr. 4, 1997

[51] Int. Cl.[6] ..... G08B 3/00

[52] U.S. Cl. ..... 340/384.6; 340/384.73; 340/388.1; 381/190; 310/322; 310/324

[58] Field of Search ..... 340/384.6, 384.73, 340/388.1, 391.1; 381/190, 191, 205; 310/322, 324; 181/143, 199

[56] References Cited

U.S. PATENT DOCUMENTS

| | | | |
|---|---|---|---|
| 3,815,129 | 6/1974 | Sweany | 340/384.6 |
| 4,139,842 | 2/1979 | Fujita et al. | 340/384.6 |
| 4,325,060 | 4/1982 | Purtell et al. | 340/604 |
| 4,374,377 | 2/1983 | Saito et al. | 340/384.6 |
| 4,486,742 | 12/1984 | Kudo et al. | 340/384.6 |
| 5,398,024 | 3/1995 | Knowles | 340/474 |

FOREIGN PATENT DOCUMENTS

| | | | |
|---|---|---|---|
| 2544-530 | 10/1984 | France | 340/384.6 |
| 2736-089 | 2/1978 | Germany | 340/384.6 |
| 61-90600 | 5/1986 | Japan | 340/384.6 |
| 3-296098 | 12/1991 | Japan | 340/384.6 |

*Primary Examiner*—Jeffery A. Hofsass
*Assistant Examiner*—Ashok Mannava
*Attorney, Agent, or Firm*—Niro, Scavone, Haller & Niro

[57] ABSTRACT

The invention is an improved noise-making device using a piezoelectric transducer where electrical circuit components are mounted directly on the transducer itself rather than being mounted on a separate printed circuit board. Directly mounting the components eliminates the need for a separate circuit board and eliminates a third terminal from a three-terminal device. As a result, the entire device requires less material and labor, and is therefore less expensive. The elimination of the circuit board also can contribute to a reduction in size of the noise-making device.

7 Claims, 4 Drawing Sheets

PIEZOELECTRIC TRANSDUCER HAVING DIRECTLY MOUNTED ELECTRICAL COMPONENTS AND NOISE MAKING DEVICE UTILIZING SAME

BACKGROUND OF THE INVENTION

The present invention relates to a transducer for a noise-making device used to provide audible alarms in a wide variety of devices including, for example, smoke detectors and medical equipment. Such devices can use a piezoelectric transducer and associated circuitry as a noise-making device. The transducer bends in response to an applied voltage. If an oscillating voltage is applied to the transducer at an appropriate rate, the flexing of the transducer produces an audible sound of substantial volume. An associated electrical circuit is used to apply the oscillatory voltage signal to the transducer.

U.S. Pat. No. 3,815,129, "Piezoelectric Transducer and Noise Making Device Utilizing Same," is incorporated by reference herein and describes an alarm device using a piezoelectric transducer. That patent shows a self-oscillating transducer employing a feedback circuit and requiring three external electrical connections ($T_1$, $T_2$, and $T_3$) between the circuit and the transducer. U.S. Pat. No. 3,879,726, "Audible Alarm Unit," incorporated by reference herein, shows an audible alarm using a piezoelectric transducer, and having a separate printed circuit board 16 carrying the components of the electrical circuit used to operate the transducer. As can be seen in FIG. 1, the housing must be large enough to accommodate the transducer, the printed circuit board, and the electrical components.

Using a printed circuit board adds to the cost of material and labor. The board also inherently prevents the alarm unit from being further reduced in size. Both disadvantages are significant, since the applications of these alarm units require that they be as inexpensive as possible, and also frequently require them to be as small as possible, while still preserving the desired alarm characteristic.

Accordingly, the present invention provides a transducer and electrical circuit assembly which greatly reduces the cost of material and labor in manufacturing an alarm by eliminating the use of a printed circuit board and the necessary external third terminal normally required in a self-oscillating piezoelectric transducer when using a separate, external circuit board.

SUMMARY OF THE INVENTION

According to the invention, there is provided a transducer-electrical circuit assembly which in general comprises a diaphragm, first and second sheets of electrically conductive material carried on opposite sides of a piezoelectric crystal, means dividing the first electrically conductive sheet into electrically isolated areas, and electrical components carried by the electrically isolated areas to be selectively connected to each other to provide an electrical circuit on the transducer itself.

The invention, when operating, further provides audible sound by means of an amplifier circuit including feedback from the transducer to the amplifier.

DETAILED DESCRIPTION OF THE INVENTION

Figure 1:
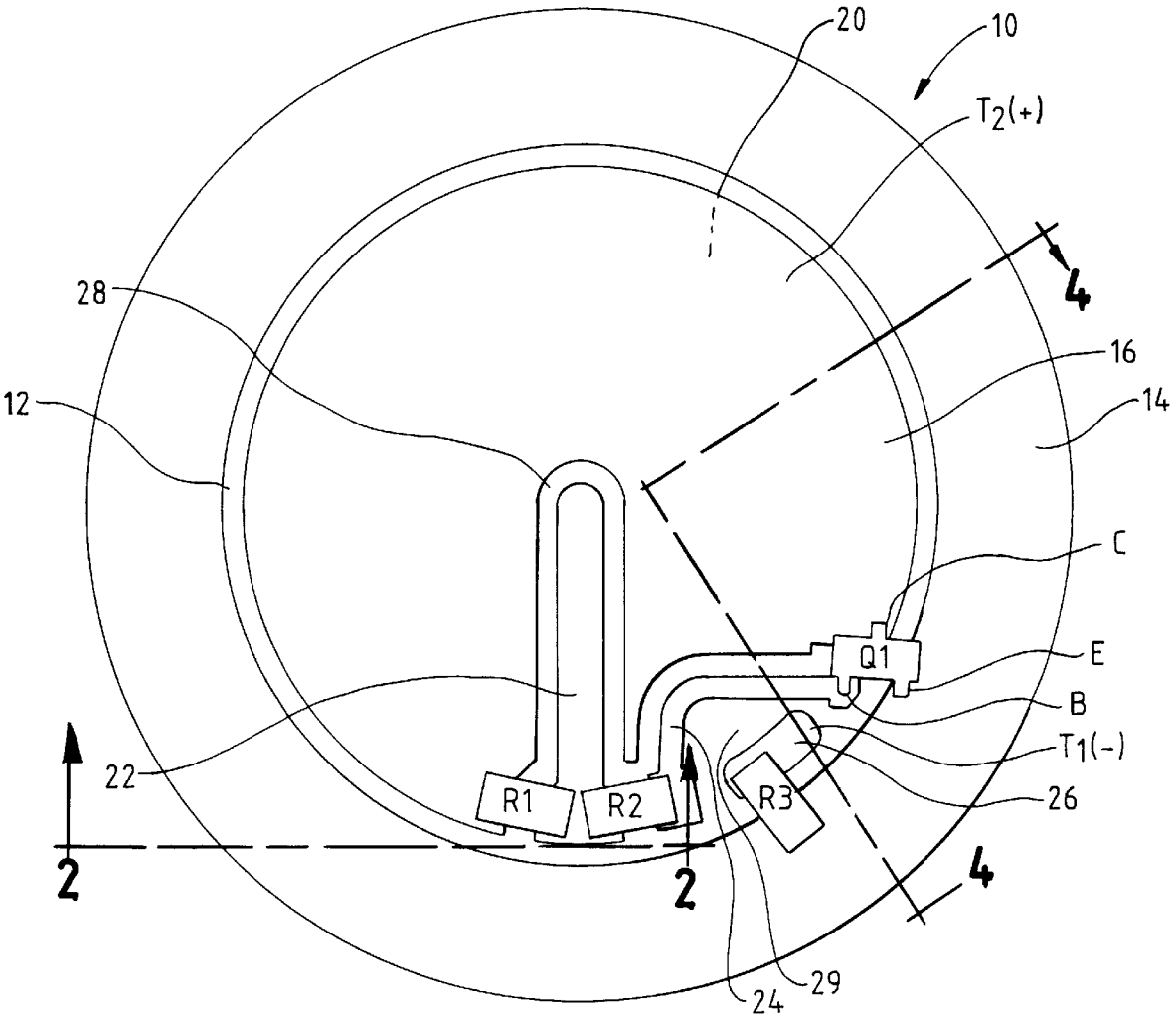
FIG. 1 is a top or plan view of the noise-making device.
Figure 2:
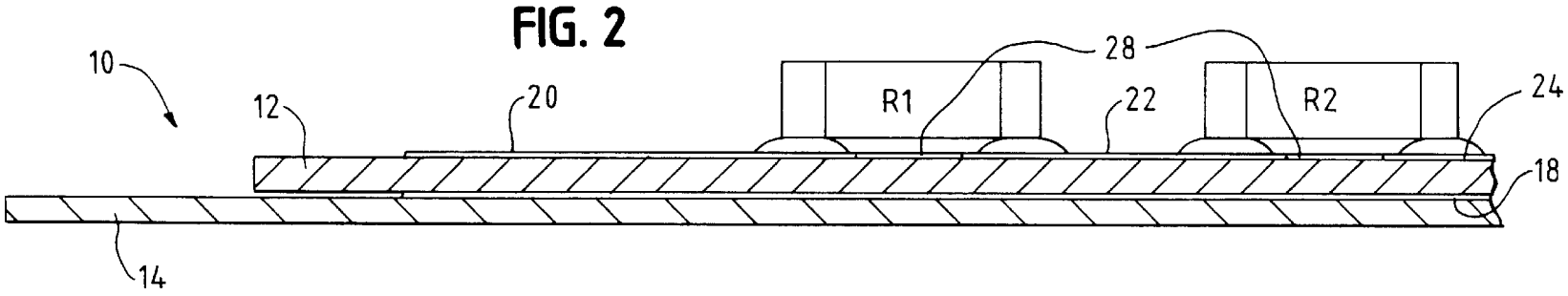
FIG. 2 is a cross-section taken on line 2—2 of FIG. 1.

Referring now to FIGS. 1 and 2, there is shown a piezoelectric crystal 12. Crystal 12 has sheets 16 and 18 mounted on its opposite sides; both sheets 16 and 18 are formed of an electrically conductive material such as silver. Sheet 16 is on top of crystal 12, as shown in FIG. 1. Sheet 18 is between crystal 12 and diaphragm 14. Crystal 12 is fabricated from a lead, zirconium and titanium composite, and is bonded to a substrate or diaphragm 14 by any suitable conductive material, such as an epoxy bonding agent. Diaphragm 14 is fabricated from a metal such as brass.

As shown in FIGS. 1 and 2, sheet 16 is divided into electrically isolated areas 20, 22, 24, and 26. A slit 28 in sheet 16 divides areas 20, 22, and 24. Another slit 29 separates areas 24 and 26.

A resistor $R_1$ is connected to areas 20 and 22. Another resistor $R_2$ is connected to areas 22 and 24. A third resistor $R_3$ is connected to area 26 and diaphragm 14. The collector C of the transistor $Q_1$ is connected to area 20. The base B of transistor $Q_1$ is connected to area 24. The emitter of transistor $Q_1$ is connected to diaphragm 14.

Figure 3:
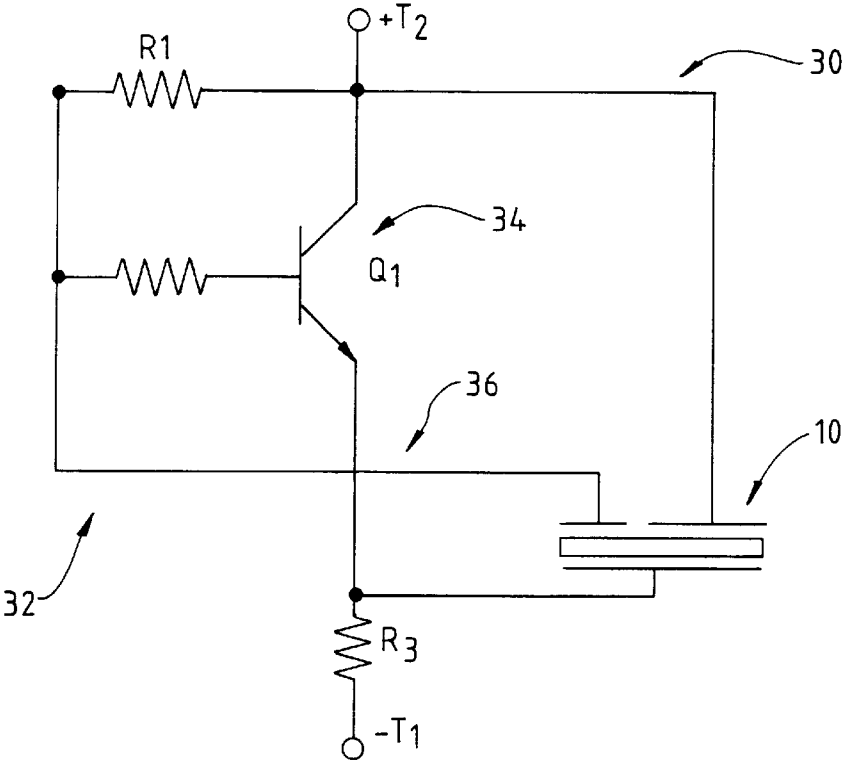
FIG. 3 is one circuit used in the present invention.

A suitable electrical circuit for use in the present invention is shown in FIG. 3, configured as a noise-making device. It should be understood, however, that the invention is not limited to the circuit embodiment shown.

Referring to FIG. 3, a noise-making device 30 includes piezoelectric transducer 10 and circuit 32. D.C. voltage is applied to circuit 32 by means of terminals $T_1$ and $T_2$, also shown in FIG. 1. An amplifier means 34 and a feedback loop 36 complete circuit 32. All of these components represented in FIG. 3 are directly mounted on the crystal 12, thus eliminating the printed circuit board shown in U.S. Pat. No. 3,879,726. The components can be attached to isolated areas 20, 22, 24 and 26 and diaphragm 14 by any means that is electrically satisfactory, for example, soldering or reflowed solder paste or electrically conductive epoxy. The components are preferably mounted near the periphery of crystal 12, and close to or on the nodal ring of crystal 12, where the least flexure occurs. That in turn minimizes stress on the electrical connections.

Figure 4:
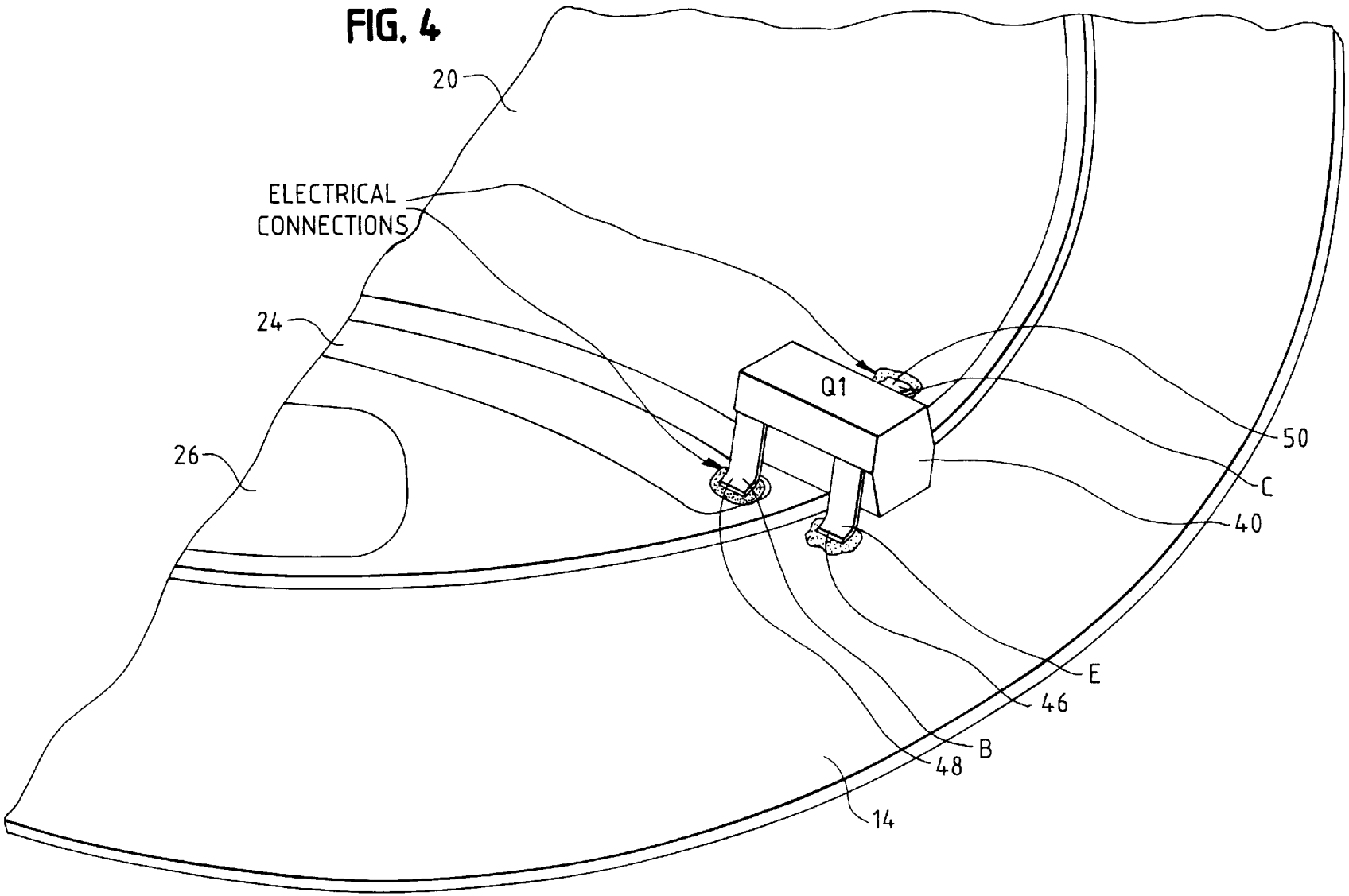
FIG. 4 is a partial, perspective view of the noise-making device, taken along line 4—4 of FIG. 1, and depicting transistor $Q_1$ and its connection to the electrically isolated areas and the diaphragm.

Transistor $Q_1$ is encapsulated in capsule 40, shown in FIG. 4. An encapsulated transistor available as part number MMBT2222A from the National Semiconductor Company may be used. Resistors $R_1$, $R_2$ and $R_3$ are any commercially available surface-mount resistors. Each of these components is connected as shown in FIGS. 1 and 3.

Referring now to FIGS. 1 and 3, the combination of diaphragm 14 and electrically isolated area 20 form a means of driving the transducer 10. The smaller area 22, electrically connected to transistor $Q_1$ through resistor $R_2$, provides the feedback loop 36. Resistors $R_1$ and $R_2$ are both connected to isolated area 22. $R_1$ is connected to isolated area 20, terminal $T_2$ and the collector C of $Q_1$. $R_2$ is connected to the base B of $Q_1$ through isolated area 24. Isolated area 26 connects terminal $T_1$ to resistor $R_3$. The emitter E of $Q_1$ and resistor $R_3$ are electrically connected to diaphragm 14. These connections provide a transistor amplifier oscillating circuit.

Figure 5:
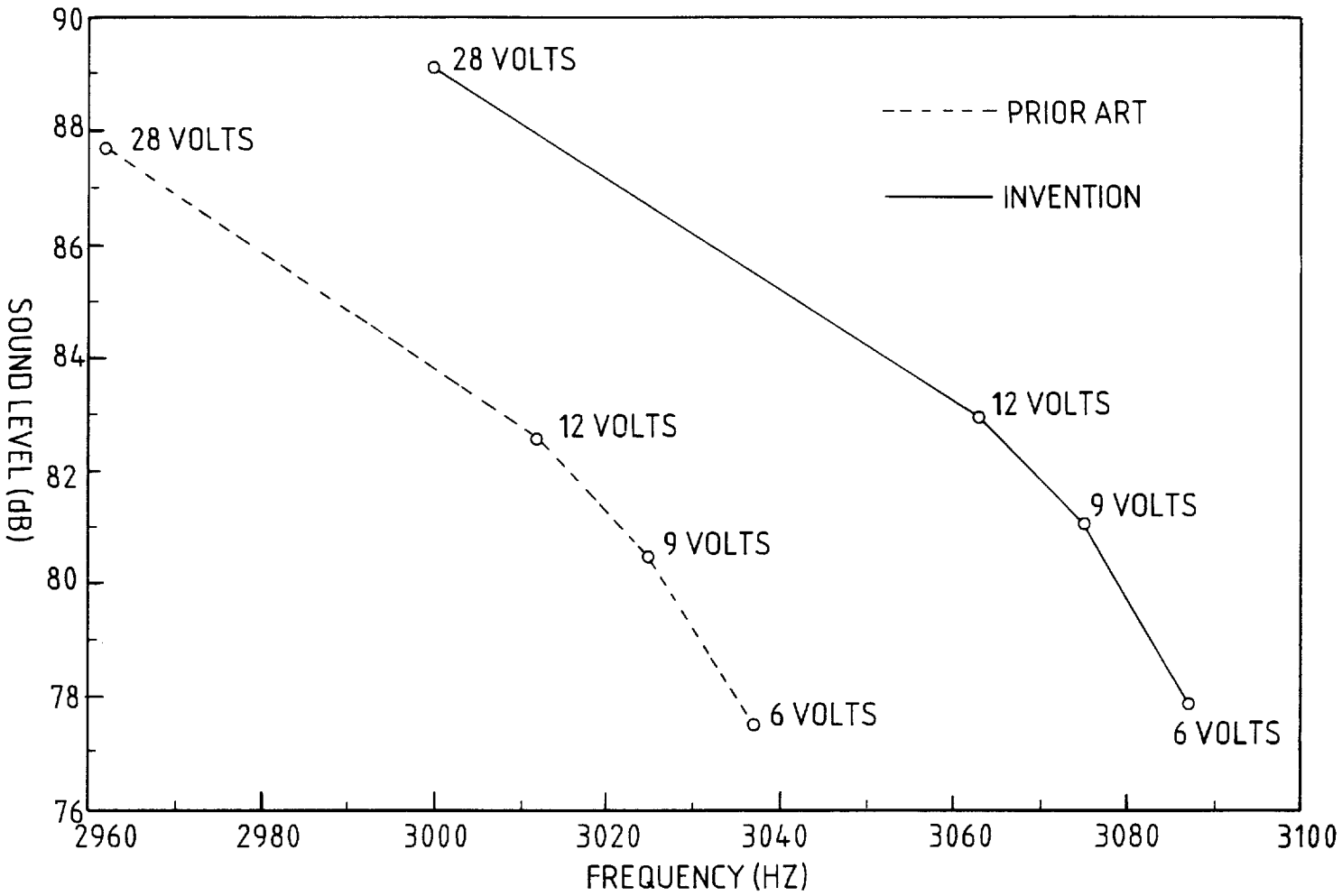
FIG. 5 is a graph of the performance of a noise-making device having no separate circuit board compared to a prior art device that does use a separate printed circuit board.

FIG. 5 shows that the invention, even though it eliminates parts required by prior art noise-makers, provides performance that is as good as that provided by prior art devices. The prior art device (the dotted line in FIG. 5)uses a transducer mounted in a housing and connected to a separate circuit board. The invention (the solid line in FIG. 5) uses a transducer with direct-mounted components with the same circuit in the same type of housing. Both devices use the circuit shown in FIG. 3. As can be seen in FIG. 5, the invention performs as well as the prior art, yet eliminates parts and is simpler and less expensive to make. The difference in frequencies shown by the two curves in FIG. 5 is due to the slight differences in resonant frequencies of the transducers used. These devices are rated plus or minus 500 Hz, so the difference in frequencies is not significant.

We claim:

1. A transducer—electrical assembly comprising:

a diaphragm;

a continuous piezoelectric crystal carried by the diaphragm;

at least one electrically conductive sheet carried on a side of the piezoelectric crystal, the electrically conductive sheet being divided into electrically isolated areas; and a transistor-amplifier circuit carried by the electrically isolated areas of the conductive sheet.

2. A noise-making device comprising:

a piezoelectric transducer including a diaphragm, a continuous piezoelectric crystal carried by the diaphragm, a sheet of electrically conductive material carried on one side of the piezoelectric crystal, means dividing the sheet into electrically isolated areas, and electrical components carried by the electrically isolated areas to be selectively electrically connected to each other to provide a transistor-amplifier circuit adapted to provide electrical energy to the piezoelectric transducer to produce an audible sound.

3. A noise-making device comprising:

a continuous piezoelectric crystal;

a conductive electrical sheet carried on the piezoelectric crystal;

electrical circuit paths formed in the electrical sheet by removing selected portions of the sheet;

a transistor-amplifier circuit, the components of which are mounted directly on the electrical sheet and which are connected using the circuit paths formed in the electrical sheet.

4. The noise-making device of claim 3, where the components of the transistor-amplifier circuit are attached to the piezoelectric crystal substantially at its nodal ring.

5. A noise-making device comprising:

a piezoelectric transducer including a layer of continuous piezoelectric crystal;

an amplifier circuit for causing the piezoelectric transducer to oscillate at a resonant, audible frequency;

electrically conductive paths carried on one side of the piezoelectric transducer;

electrical components forming a transistor-amplifier circuit and carried by to the electrically conductive paths.

6. The noise-making device of claim 5 wherein the electrical components of the transistor-amplifier circuit are attached to the electrically conductive paths at the nodal ring of the transducer crystal.

7. A noise-making device comprising:

a piezoelectric transducer including a continuous layer of piezoelectric crystal;

electrically conductive paths on one side of the transducer; and a transistor-amplifier circuit whose components are carried by means of the electrically conductive paths.

* * * * *